US010392867B2

(12) United States Patent
Savage et al.

(10) Patent No.: US 10,392,867 B2
(45) Date of Patent: Aug. 27, 2019

(54) EARTH-BORING TOOLS UTILIZING SELECTIVE PLACEMENT OF SHAPED INSERTS, AND RELATED METHODS

(71) Applicant: Baker Hughes, a GE company, LLC, Houston, TX (US)

(72) Inventors: Michael T. Savage, Magnolia, TX (US); Juan Miguel Bilen, The Woodlands, TX (US); Anthony Phillips, The Woodlands, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 177 days.

(21) Appl. No.: 15/581,776

(22) Filed: Apr. 28, 2017

(65) Prior Publication Data

US 2018/0313161 A1 Nov. 1, 2018

(51) Int. Cl.
*E21B 10/42* (2006.01)
*E21B 10/43* (2006.01)
(Continued)

(52) U.S. Cl.
CPC ..... *E21B 10/43* (2013.01); *E21B 10/54* (2013.01); *E21B 10/5673* (2013.01); *E21B 2010/425* (2013.01); *E21B 2010/545* (2013.01)

(58) Field of Classification Search
CPC ..... E21B 10/43; E21B 10/54; E21B 10/5673; E21B 2010/545; E21B 2010/425; E21B 10/16; E21B 10/42; E21B 10/46; E21B 10/485; E21B 10/55; E21B 10/56; E21B 10/58; E21B 10/52
See application file for complete search history.

(56) References Cited

U.S. PATENT DOCUMENTS 4,815,342 A 3/1989 Brett et al.
5,010,789 A 4/1991 Brett et al.
(Continued)

OTHER PUBLICATIONS

Vempati et al., Cutting Elements, Earth-Boring Tools Including the cutting Elements, and Methods fo Forming the Cutting Elements, U.S. Appl. No. 15/374,891, filed Dec. 9, 2016.
(Continued)

*Primary Examiner* — David J Bagnell
*Assistant Examiner* — Jonathan Malikasim
(74) *Attorney, Agent, or Firm* — TraskBritt

(57) ABSTRACT

An earth-boring tool includes a body, blades extending longitudinally and generally radially from the body, and cutting elements located on each blade. The earth-boring tool may also include a first group of at least two adjacent blades comprising the cutting elements proximate a front cutting edge of the blades and one or more shaped inserts located rotationally following the cutting elements, and a second group of one or more additional blades comprising the cutting elements proximate the front cutting edge of the blades while being entirely free of the one or more shaped inserts. Methods include drilling a subterranean formation including engaging a formation with the cutting elements and the shaped inserts of the earth-boring tool, the shaped inserts secured at selected locations on two or more adjacent blades of the first group of blades while the second group of blades is entirely free of the shaped inserts.

19 Claims, 7 Drawing Sheets

(51) Int. Cl.
*E21B 10/54* (2006.01)
*E21B 10/567* (2006.01)

(56) References Cited

U.S. PATENT DOCUMENTS

| | | | | |
|---|---|---|---|---|
| 5,042,596 | A | 8/1991 | Brett et al. | |
| 5,099,929 | A | 3/1992 | Keith et al. | |
| 5,099,934 | A | 3/1992 | Barr | |
| 5,109,935 | A | 5/1992 | Hawke | |
| 5,111,892 | A | 5/1992 | Sinor et al. | |
| 5,119,892 | A | 6/1992 | Clegg et al. | |
| 5,131,478 | A | 7/1992 | Brett et al. | |
| 5,163,524 | A | 11/1992 | Newton, Jr. et al. | |
| 5,165,494 | A | 11/1992 | Barr | |
| 5,186,268 | A | 2/1993 | Clegg | |
| 5,287,936 | A | 2/1994 | Grimes | |
| 5,346,026 | A | 9/1994 | Pessier et al. | |
| 5,467,836 | A | 11/1995 | Grimes et al. | |
| 5,558,170 | A | 9/1996 | Thigpen et al. | |
| 5,655,612 | A | 8/1997 | Grimes | |
| 5,752,573 | A | 5/1998 | Scott et al. | |
| 5,873,422 | A | 2/1999 | Hansen et al. | |
| 6,039,131 | A | 3/2000 | Beaton | |
| 6,050,354 | A | 4/2000 | Pessier et al. | |
| 6,308,790 | B1 | 10/2001 | Mensa-Wilmot et al. | |
| 6,332,503 | B1 | 12/2001 | Pessier et al. | |
| 6,332,504 | B1 | 12/2001 | Adds | |
| 6,615,934 | B2 | 9/2003 | Mensa-Wilmot | |
| 7,621,348 | B2 | 11/2009 | Hoffmaster et al. | |
| 7,762,355 | B2 * | 7/2010 | McClain | E21B 10/55 175/431 |
| 8,127,869 | B2 | 3/2012 | Vempati et al. | |
| 8,439,136 | B2 * | 5/2013 | Jones | E21B 10/55 175/431 |
| 8,505,634 | B2 | 8/2013 | Lyons et al. | |
| 8,794,356 | B2 | 8/2014 | Lyons et al. | |
| 8,851,207 | B2 | 10/2014 | Gavia et al. | |
| 8,854,373 | B2 | 10/2014 | Pessier et al. | |
| 8,925,654 | B2 | 1/2015 | Zahradnik | |
| 9,051,795 | B2 | 6/2015 | Hall et al. | |
| 9,200,483 | B2 | 12/2015 | Gavia et al. | |
| 9,587,438 | B2 | 3/2017 | Chen | |
| 10,107,041 | B2 * | 10/2018 | Herman | E21B 10/43 |
| 2007/0278014 | A1 | 12/2007 | Cariveau | |
| 2009/0084607 | A1 | 4/2009 | Ernst et al. | |
| 2013/0153305 | A1 | 6/2013 | Chrest | |
| 2014/0262511 | A1 * | 9/2014 | Bilen | E21B 7/064 175/40 |
| 2015/0322781 | A1 | 11/2015 | Pelletier et al. | |
| 2016/0215568 | A1 | 7/2016 | Chen et al. | |

OTHER PUBLICATIONS

International Search Report for International Application No. PCT/US2018/029409 dated Jul. 31, 2018, 3 pages.
International Written Opinion for International Application No. PCT/US2018/029409 dated Jul. 31, 2018, 7 pages.

* cited by examiner

EARTH-BORING TOOLS UTILIZING SELECTIVE PLACEMENT OF SHAPED INSERTS, AND RELATED METHODS

TECHNICAL FIELD

Embodiments of the present disclosure relate to earth-boring tools utilizing selective placement of shaped inserts, and related methods.

BACKGROUND

Earth-boring tools are used to form boreholes (e.g., wellbores) in subterranean formations. Such earth-boring tools include, for example, drill bits, reamers, mills, etc. For example, a fixed-cutter earth-boring rotary drill bit (often referred to as a "drag" bit) generally includes a plurality of cutting elements secured to a face of a bit body of the drill bit. The cutting elements are fixed in place when used to cut formation materials. A conventional fixed-cutter earth-boring rotary drill bit includes a bit body having generally radially projecting and longitudinally extending blades. During drilling operations, the drill bit is positioned at the bottom of a well borehole and rotated as weight-on-bit (WOB) is applied.

A plurality of cutting elements is positioned on each of the blades. The cutting elements commonly comprise a "table" of superabrasive material, such as mutually bound particles of polycrystalline diamond, formed on a supporting substrate of a hard material, such as cemented tungsten carbide. Such cutting elements are often referred to as "polycrystalline diamond compact" (PDC) cutting elements. The plurality of PDC cutting elements may be fixed within cutting element pockets formed in each of the blades (e.g., formed in rotationally leading surfaces of each of the blades). Conventionally, a bonding material, such as a braze alloy, may be used to secure the cutting elements to the bit body. One or more surfaces of the cutting table act as a cutting face of the cutting element. During a drilling operation, one or more portions of the cutting face are pressed into a subterranean formation. As the earth-boring tool moves (e.g., rotates) relative to the subterranean formation, the cutting table drags across surfaces of the subterranean formation and the cutting face removes (e.g., shears, cuts, gouges, crushes, etc.) a portion of formation material.

Rotary drill bits carrying such PDC cutting elements have proven very effective in achieving high rates of penetration in drilling subterranean formations exhibiting low to medium hardness. In harder subterranean formations, the WOB applied on a downhole tool, such as a PDC bit, and similarly the torque-on-bit (TOB) applied to the tool, are typically limited to protect the PDC cutting elements. In order to obtain higher rate-of-penetration (ROP) in hard subterranean formations, PDC bits may be used at increased rates of rotation (i.e., increased revolutions per minute (RPM)). At higher RPMs, however, the bit may become particularly prone to dynamic dysfunctions caused by instability of the bit, which may result in damage to the PDC cutting elements, the bit body, or both.

Adjustments may be made to the bit structure in order to increase drilling efficiency while reducing mechanical specific energy (MSE) (i.e., the amount of energy required to remove a given volume of rock). Improvements in stability of rotary drill bits have reduced prior, notable tendencies of such bits to vibrate in a deleterious manner. Several approaches to realizing drilling stability have been independently practiced on bits, including anti-whirl or high-imbalance designs, low-imbalance designs, and kerfing.

One approach for increasing stability involves configuring the rotary drill bit with a selected imbalance force configuration and is conventionally referred to as a so called "anti-whirl" bit. Bit "whirl" is a phenomenon wherein the bit precesses around the well bore and against the side wall in a direction counter to the direction in which the bit is being rotated. Whirl may result in a borehole of enlarged (over gauge) dimension and out of round shape and may also result in damage to the cutters and the drill bit. A so called anti-whirl design or high-imbalance concept typically endeavors to generate an imbalance force (i.e., the imbalance force being the summation of each of the drilling forces generated by each of the cutting elements disposed on a rotary drill bit) that is directed toward a gage pad or bearing pad that slidingly engages the wall of the borehole. Such a configuration may tend to stabilize a rotary drill bit as it progresses through a subterranean formation.

Various other methods and equipment have been proposed to enhance (e.g., magnify) the natural imbalance forces, including using dynamically balanced lower drillstring assemblies and realigning the cutters to enhance the imbalance forces.

BRIEF SUMMARY

In one embodiment of the disclosure, an earth-boring tool includes a body having a longitudinal axis. The earth-boring tool also includes blades extending longitudinally and generally radially from the body and cutting elements located on each blade. The earth-boring tool may also include a first group of at least two adjacent blades, each blade of the first group of at least two adjacent blades comprising the cutting elements proximate a front cutting edge of the blades and one or more shaped inserts located rotationally following the cutting elements, and a second group of one or more additional blades, each blade of the second group of one or more additional blades comprises the cutting elements proximate the front cutting edge of the blades while being entirely free of the one or more shaped inserts.

In another embodiment of the disclosure, a method of drilling a subterranean formation includes applying weight-on-bit to an earth-boring tool substantially along a longitudinal axis thereof and rotating the earth-boring tool, and engaging a formation with cutting elements and one or more shaped inserts of the earth-boring tool, wherein each blade of a first group of at least two adjacent blades comprises the cutting elements proximate a front cutting edge of the blades and the one or more shaped inserts located rotationally following the cutting elements while each blade of a second group of one or more additional blades comprises the cutting elements proximate the front cutting edge of the blades while being entirely free of the one or more shaped inserts.

BRIEF DESCRIPTION OF THE DRAWINGS

While the specification concludes with claims particularly pointing out and distinctly claiming what are regarded as embodiments of the present disclosure, various features and advantages of disclosed embodiments may be more readily ascertained from the following description when read with reference to the accompanying drawings, in which:

DETAILED DESCRIPTION

The illustrations presented herein are not actual views of any particular earth-boring tool, drill bit, cutting element, or component of such a tool or bit, but are merely idealized representations that are employed to describe embodiments of the present disclosure.

As used herein, the term "earth-boring tool" means and includes any tool used to remove formation material and form a bore (e.g., a wellbore) through the formation by way of removing the formation material. Earth-boring tools include, for example, rotary drill bits (e.g., fixed-cutter or "drag" bits and roller cone or "rock" bits), hybrid bits including both fixed cutters and roller elements, coring bits, bi-center bits, reamers (including expandable reamers and fixed-wing reamers), and other so-called "hole-opening" tools, etc.

As used herein, the term "cutting element" means and includes any element of an earth-boring tool that is configured to cut or otherwise remove formation material when the earth-boring tool is used to form or enlarge a bore in the formation. In particular, "cutting element," as that term is used herein with regard to implementation of embodiments of the present disclosure, means and includes cutting elements oriented at an angle of from about two degrees (2°) to about forty-five degrees (45°) measured between a longitudinal axis of a cutting element and a phantom line extending from an outer surface of a blade of an earth-boring tool.

As used herein, the term "shaped insert" means and includes any element of an earth-boring tool that includes a cutting table exhibiting a shaped geometry (e.g., dome-shaped, cone-shaped, chisel-shaped, etc.). In particular, "shaped insert," as that term is used herein with regards to implementation of embodiments of the present disclosure, means and includes elements oriented at an angle of from about seventy degrees (70°) to about one hundred ten degrees (110°) measured between a longitudinal axis of a shaped insert and an outer surface of a blade of an earth-boring tool.

As used herein, the term "rotationally following" means rotationally behind a cutting element, but not necessarily following in the same path.

As used herein, the term "and/or" includes any and all combinations of one or more of the associated listed items.

As used herein, the term "substantially" in reference to a given parameter means and includes to a degree that one skilled in the art would understand that the given parameter, property, or condition is met with a small degree of variance, such as within acceptable manufacturing tolerances. For example, a parameter that is substantially met may be at least about 90% met, at least about 95% met, or even at least about 99% met.

Figure 1:
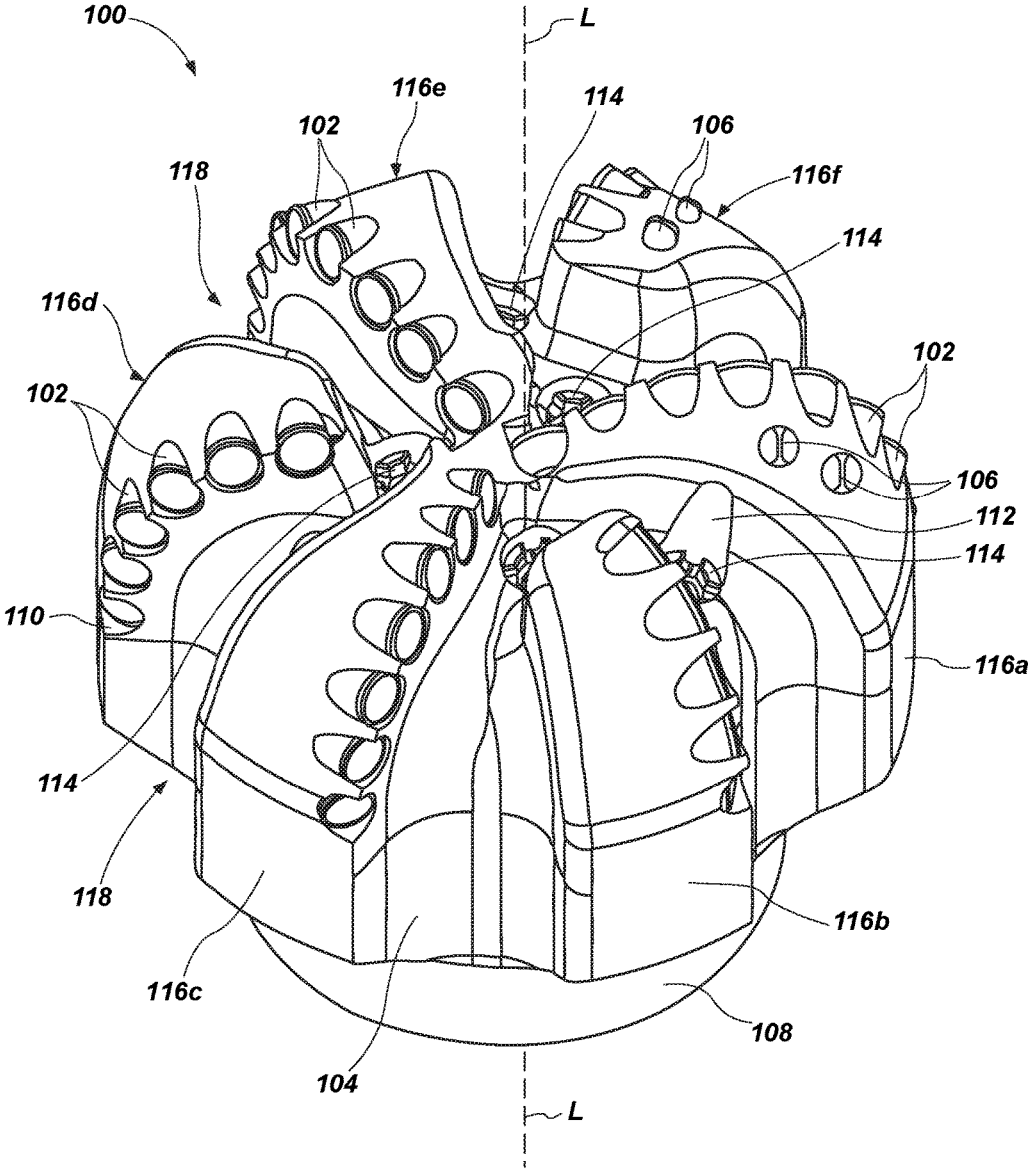
FIG. 1 is a perspective view of an earth-boring drill bit including selective placement of shaped inserts of the disclosure.

FIG. 1 is a perspective view of an embodiment of an earth-boring tool 100 of the present disclosure. The earth-boring tool 100 of FIG. 1 is configured as an earth-boring rotary drill bit. The earth-boring tool 100, more specifically, comprises a drag bit having a plurality of cutting elements 102 disposed within pockets 110 and affixed to a body 104 of the earth-boring tool 100. The earth-boring tool 100 also includes one or more shaped inserts 106 affixed to the body 104. The present disclosure relates to embodiments of earth-boring tools including selective placement of the shaped inserts 106 to improve stability of the drill bit by enhancing (e.g., magnifying) imbalance forces during drilling operations.

The body 104 of the earth-boring tool 100 may be secured to a shank 108 having a threaded connection portion (not shown), which may conform to industry standards, such as those promulgated by the American Petroleum Institute (API), for attaching the earth-boring tool 100 to a drill string (not shown). The body 104 may include internal fluid passageways that extend between fluid ports 112 at the face of the body 104 and a longitudinal bore that extends through the shank 108 and partially through the body 104. Nozzle inserts 114 may be secured within the fluid ports 112 of the internal fluid passageways. The body 104 may include a plurality of blades 116 (e.g., blades 116*a* through 116*f*) that are separated by fluid courses 118, portions of which, along the gage of the earth-boring tool 100, may be referred to in the art as "junk slots." While the earth-boring tool 100, as depicted in the embodiment of FIG. 1, includes six blades (i.e., three primary blades and three secondary blades), it is to be recognized that the earth-boring tool 100 may have fewer or greater number of blades. The shaped inserts 106 may be selectively placed on specific blades (e.g., two or more adjacent blades) of the body 104 in order to improve stability, as discussed in further detail below.

The cutting elements 102 may comprise PDC cutting elements including a diamond table secured to a supporting substrate. It is also contemplated that the table may, alternatively be formed of cubic boron nitride. In some embodiments, the cutting elements may each comprise a disc-shaped diamond table on an end surface of a generally cylindrical cemented carbide substrate and having a substantially planar cutting face opposite the substrate and, in some embodiments, may be configured to be a shearing cutting element. In other embodiments, the cutting face topography of the cutting faces of the cutting elements 102, or portions thereof, may be non-planar. Further, the cutting face of the cutting elements 102 may include one or more adjacent peripheral chamfered cutting edges. The shaped inserts 106 may also comprise PDC cutting elements including a diamond table secured to a supporting substrate. However, the shaped inserts 106 may have a non-planar (e.g., dome-shaped, cone-shaped, chisel-shaped, etc.) cutting face and, in some embodiments, may be configured to be a gouging cutting element. Further, a cutting face or leading face of the cutting elements 102 and/or the shaped inserts 106 may be treated (e.g., polished) to exhibit a greatly reduced surface roughness.

One or more of the shaped inserts 106 may be located in selected regions (e.g., nose or shoulder region) of the body 104 and may be located proximate to at least one or more of the cutting elements 102. In some embodiments, the cutting elements 102 may be positioned proximate a front cutting edge of a respective blade 116 (e.g., at a rotationally leading edge of the blade 116). By way of non-limiting example, two or more of the shaped inserts 106 may be positioned proximate one another on the blades 116 and may be disposed at selected locations rotationally following the cutting elements 102 on the same blade 116. It is to be appreciated that the cutting elements 102 and the shaped inserts 106 may be positioned in any configuration in order to provide stability to the body 104 during drilling operations.

In some embodiments, an exposure (e.g., height, back rake angle, etc.) of the cutting elements 102 and the shaped inserts 106 may be substantially the same relative to an adjacent surface of the blade 116. In other embodiments, an exposure of the cutting elements 102 and the shaped inserts 106 may differ. For example, an exposure of the shaped inserts 106 may be less than an exposure of the cutting elements 102 relative to an adjacent surface of the blade 116. More specifically, the shaped insert 106 may be at least partially located behind and not exposed above a rotationally leading cutting element 102 secured to the same blade 116 as the shaped insert 106. As a specific, nonlimiting example, the shaped insert 106 may be located directly rotationally behind and at least partially within a cutting path (e.g., a kerf) traversed by the cutting element 102. In other embodiments, the shaped inserts 106 may be located adjacent to the cutting path traversed by the cutting element 102 and positioned to directly engage the formation. In addition, the cutting elements 102 may be positioned as primary cutters along the rotationally leading edge of the blade 116, and the shaped inserts 106 may be positioned as so-called "back up" cutters rotationally trailing the cutting elements 102. Such back up cutters may be positioned to exhibit an exposure the same as, greater than, or less than, an associated primary cutter as discussed above. In other embodiments, the shaped inserts 106 may be positioned as primary cutters relative to the cutting elements 102 located on a rotationally following blade 116. It may be appreciated that any combination of the cutting elements 102, the shaped inserts 106, and/or non-cutting bearing elements may be utilized in combination in order to provide specific benefits for increased stability during drilling operations of various subterranean formations.

The shaped inserts 106 may be positioned exclusively on two or more adjacent blades, as shown in FIG. 1. In such a configuration, one or more (e.g., two) shaped inserts 106 may be located on blade 116*a*, which may have the cutting element 102 positioned within a first radially innermost pocket of the blade 116*a* and proximate a longitudinal axis L of the body 104. In addition, one or more of the shaped inserts 106 may be located on an adjacent blade 116 (e.g., blade 116*f*), while all remaining blades 116 of the body 104 remain entirely free of the shaped inserts 106. In other embodiments, the shaped inserts 106 may be selectively located on additional adjacent blades 116 of the body 104. For example, the shaped inserts 106 may be located on three or more adjacent blades 116, while all other blades 116 remain entirely free of the shaped inserts 106. In other words, selective placement of the shaped inserts 106 on the blades 116 may result in a blade configuration that is asymmetric with respect to the longitudinal axis L.

Further, the blades 116 (e.g., blades 116*a* and 116*f*) containing the shaped inserts 106 may be located on a side of the body 104 farthest from a known imbalance force acting on the body 104. In such a configuration, all other remaining blades 116 (e.g., blades 116*b* through 116*e*) may be entirely free of the shaped inserts 106, which other blades 116 may be closest to the known imbalance force acting on the body 104. It may be appreciated that while the configuration of FIG. 1 specifies that the shaped inserts 106 are located on blades 116*a* and 116*f*, one of ordinary skill in the art will readily appreciate that any two or more adjacent blades (e.g., farthest from the imbalance force) may include the shaped inserts 106 in order to enhance the imbalance force acting on the body 104. In other words, selective placement of the shaped inserts 106 may result in a blade configuration that is asymmetric with respect to the longitudinal axis L, such that a natural imbalance force of a drill bit is enhanced. Therefore, the specific embodiments of the arrangement of blades 116 are shown by way of example only while specific tool configurations may be tailored to meet the individual requirements of each bit body. The imbalance force acting on the body 104 may be calculated using conventional methods by persons having ordinary skill in the art. Thus, it is to be recognized that the imbalance force will vary between differing drill bits and various earth-boring tools. For example, differing bit types and sizes, including differing cutting element types and placement along with differing blade configurations, will affect imbalance forces on each individual bit body. Once the magnitude and direction of the imbalance forces are calculated, the shaped inserts 106 may be positioned on specific blades 116 to enhance (e.g., magnify) the calculated imbalance forces in order to provide increased stability to the earth-boring tool 100.

In embodiments of the present disclosure, selective placement of additional cutting elements, such as the shaped inserts 106, may serve to enhance the imbalance forces on a given drill bit. Drilling characteristics of a particular bit, such as Stability Level, ROP and/or TOB may be enhanced by selection of the number and placement of the shaped inserts 106 relative to the number and placement of the cutting elements 102. It is contemplated that cutting elements 102 and shaped inserts 106 may be selectively positioned relative to one another on the blades 116. In addition, smaller bits (e.g., 6.5 inch diameter or less drill bits) which may have limited blade surface area and/or material volume for cutting elements and/or bearing elements may employ shaped inserts according to the disclosure for enhanced stability. Further, the number of cutters (i.e., cutter density) may remain the same or may differ from that of conventional blades in order to accommodate selective placement of the shaped inserts 106 among the cutting elements 102. In other embodiments, as the shaped inserts 106 are added to or removed from blades 116, placement and exposure of the cutting elements 102 may be maintained. In other words, an original bit design may not change with the exception of adding or removing the shaped inserts 106 in selected locations (e.g., nose or shoulder regions) of the body 104. Finally, selective placement of the shaped inserts 106 may be utilized on other earth-boring tools, such as, for example, hybrid bits and other earth-boring tools employing fixed cutting elements and which may include bodies and/or blades that are fabricated from either steel or a hard metal "matrix" material.

Figure 2:
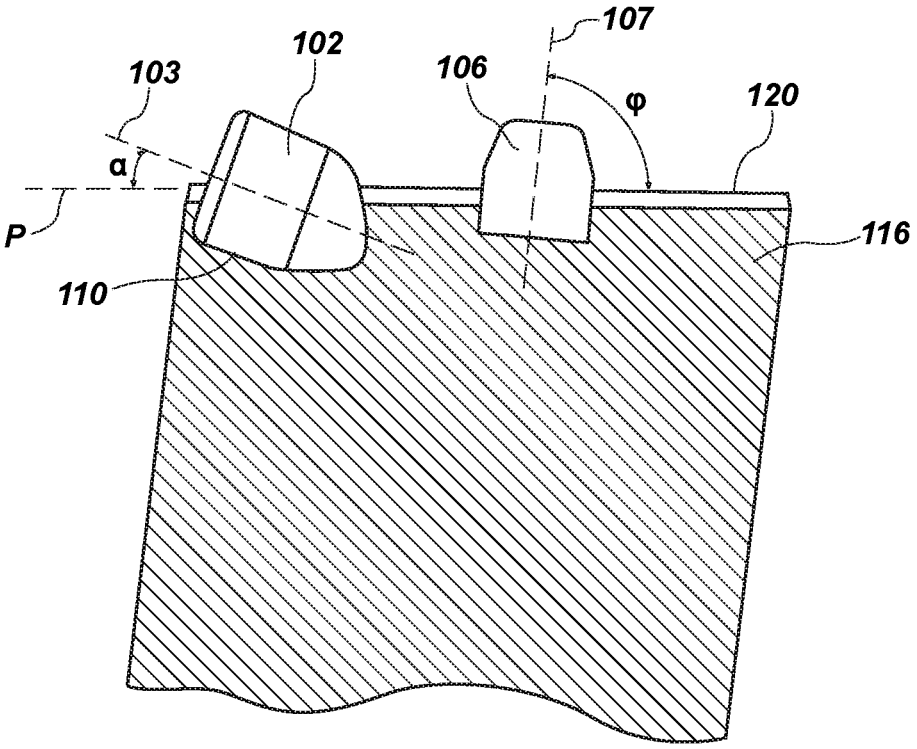
FIG. 2 is a cross-sectional view of a blade of an embodiment of the earth-boring drill bit of the disclosure.

FIG. 2 is a cross-sectional view of a blade 116. The cutting elements 102 may be disposed within the pockets 110 of the blades 116 and oriented at an angle $\alpha$ existing between a longitudinal axis 103 of the cutting elements 102 and a phantom line P extending from an outer surface 120 of the blades 116. By way of example and not limitation, the angle α may be within a range of from about two degrees (2°) to about forty-five degrees (45°). The shaped inserts 106 may be positioned within the pockets 110 of the blades 116 and oriented at an angle ϕ existing between a longitudinal axis 107 of the shaped inserts 106 and a phantom line P extending from an outer surface 120 of the blades 116. By way of example and not limitation, the angle ϕ may be within a range of from about seventy degrees (70°) to about one hundred ten degrees (110°). In one embodiment, the angle ϕ may be about seventy-five degrees (75°). The Assignee of the present disclosure has designed so called "shaped cutting elements" including a cutting table exhibiting a shaped geometry (e.g., dome-shaped, cone-shaped, chisel-shaped, etc.) received in apertures in axially leading blade surfaces. U.S. Pat. No. 8,794,356, issued Aug. 5, 2014, U.S. Pat. No. 8,505,634, issued Aug. 13, 2013, and U.S. patent application Ser. No. 15/374,891, filed Dec. 9, 2016, each of which are assigned to the Assignee of the present disclosure, and the disclosure of each of which is incorporated herein in its entirety by this reference, disclose cutting elements including a cutting table exhibiting such a shaped geometry disposed within receptacles of a body of an earth-boring tool.

Figure 3:
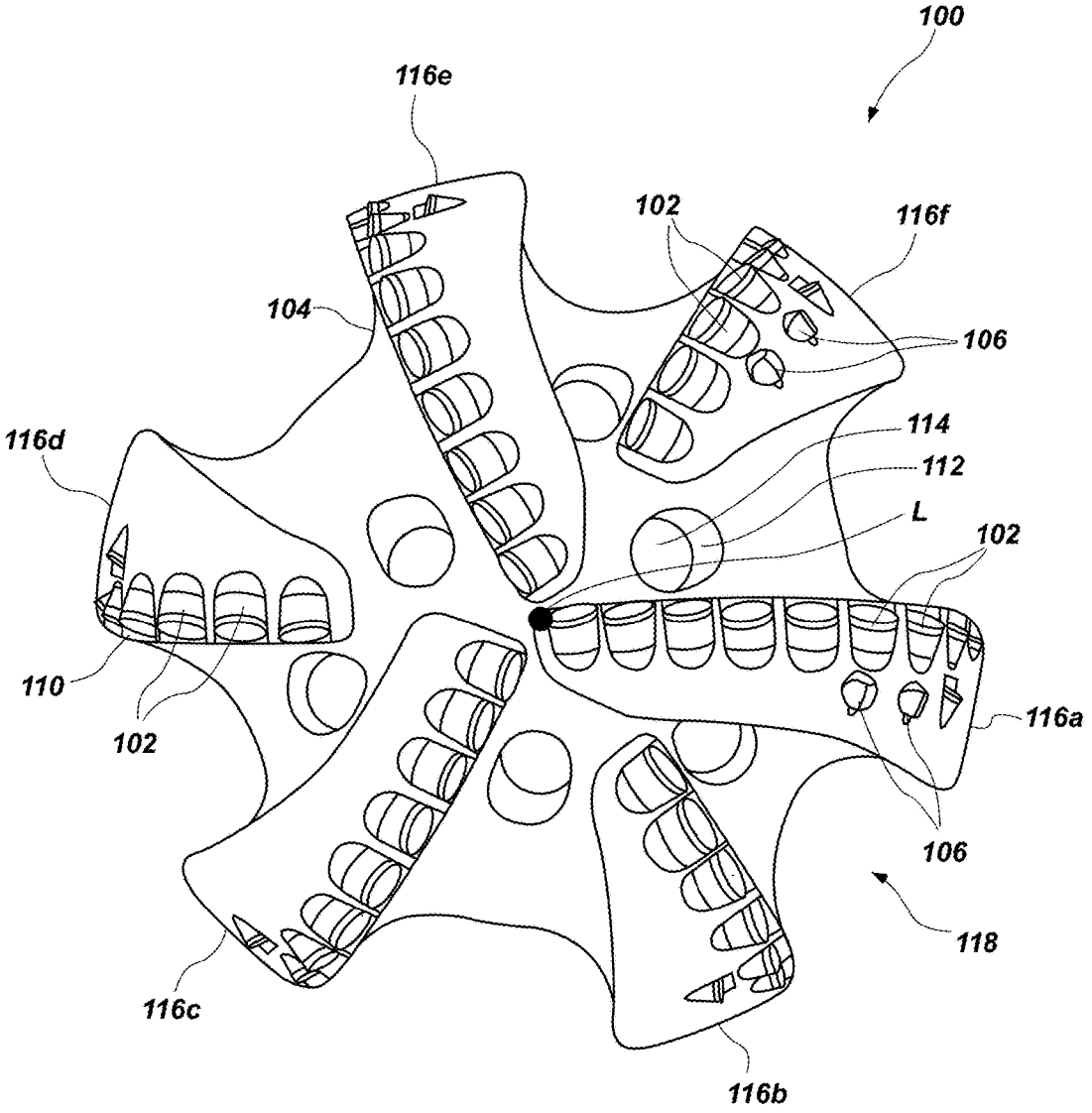
FIG. 3 is a face view of an embodiment of the earth-boring drill bit of the disclosure.

FIG. 3 is a face view illustrating the earth-boring tool 100 of FIG. 1. As discussed above, the earth-boring tool 100 comprises a drag bit having the cutting elements 102 disposed within the pockets 110 of the blades 116 (i.e., 116*a* through 116*f*) of the body 104. The earth-boring tool 100 also includes one or more of the shaped inserts 106 disposed within the pockets 110 of a group of two or more adjacent blades 116 (e.g., 116*a* and 116*f*). In such a configuration, the shaped inserts 106 may be positioned within the pockets 110 of each of designated blades 116*a* and 116*f* and may be located proximate to the cutting elements 102, providing a total of four of the shaped inserts 106, two of which are located on each of the designated blades 116*a* and 116*f* In addition, one or more rows (e.g., a single row) of the cutting elements 102 may be located proximate to the front cutting edge of each of the blades 116 (e.g., between the rotationally leading edge and the shaped inserts 106) and the shaped inserts 106 may be positioned to rotationally follow the cutting elements 102 on the same blade 116. In other words and by way of example only, two of the shaped inserts 106 may be positioned within the pockets 110 on each of the designated blades 116*a* and 116*f* of the group of two or more adjacent blades 116, making a total of four of the shaped inserts 106, while another group of one or more adjacent blades 116 including all remaining blades 116*b* through 116*e* lack any of the shaped inserts 106. However, it is to be appreciated that any number of the shaped inserts 106 may be positioned in the pockets 110 and located proximate to (e.g., rotationally following) the cutting elements 102 on the same blade 116.

In some embodiments, other regions (e.g., cone, flank, gage regions) of the body 104 may remain entirely free of the shaped inserts 106. In other embodiments, the cone, nose, flank, shoulder, and gage regions of the body 104 may or may not include the shaped inserts 106. Further, additional rows of the cutting elements 102 may be positioned in the pockets 110 and located proximate to (e.g., rotationally following) the row of the cutting elements 102 located proximate to the front cutting edge of the blades 116. In other words, the cutting elements 102 may be positioned, either singly, in partial rows, or in full rows in additional (e.g., rotationally following) portions of the blades 116. Thus, the shaped inserts 106 may be secured in a predetermined pattern and on a predetermined set of adjacent blades 116 (i.e., on a specific side of the body 104) in order to provide effective cutting for the formation type to be cut along with providing stability to the earth-boring tool 100.

Figure 4:
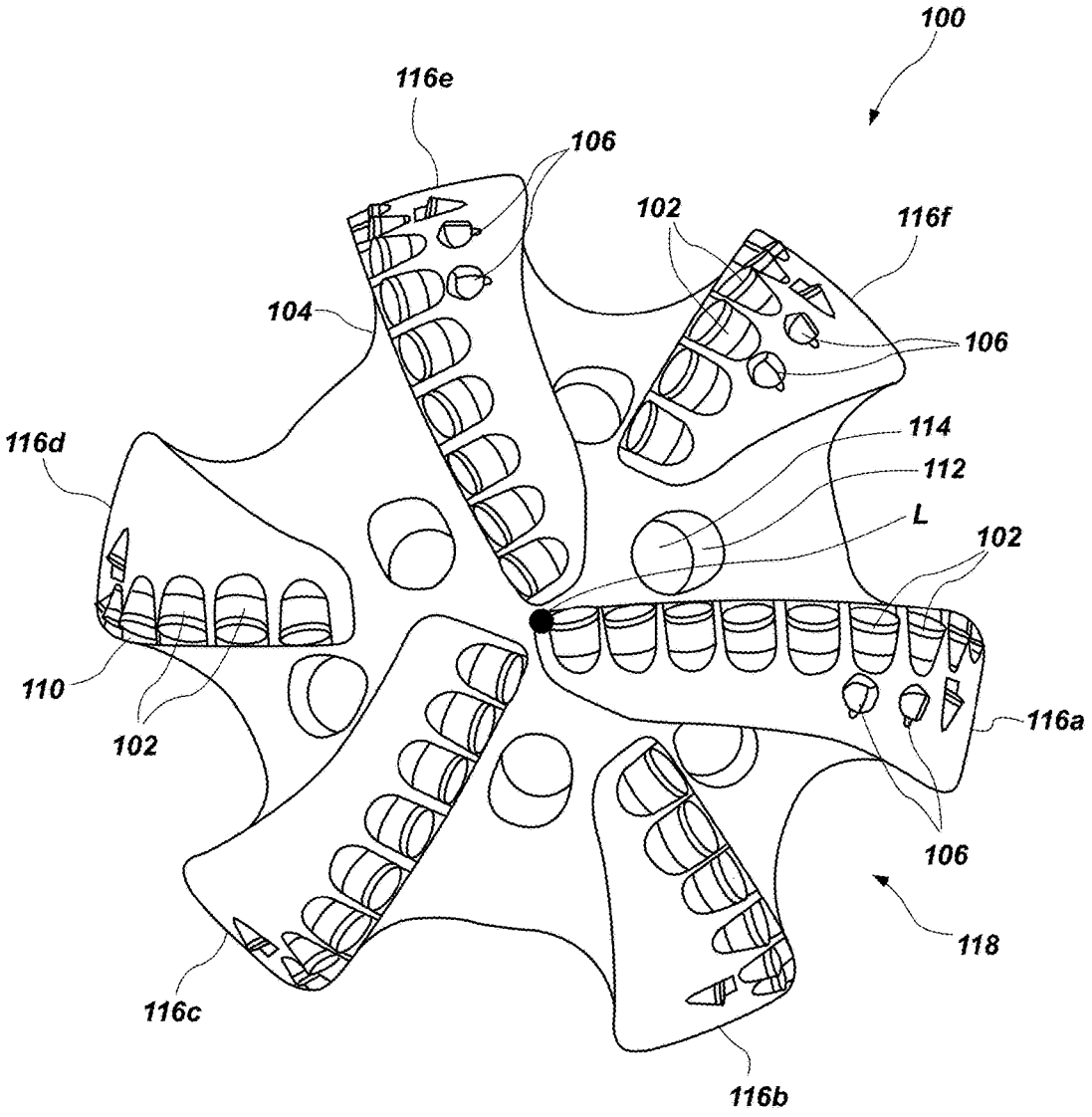
FIG. 4 is a face view of an additional embodiment of the earth-boring drill bit of the disclosure.

As previously described above, the earth-boring tool 100 may be formed to exhibit a different configuration than that depicted in FIGS. 1 and 3. By way of non-limiting example, FIG. 4 shows a face view of an additional embodiment of the earth-boring tool 100, in accordance with additional embodiments of the disclosure. To avoid repetition, not all features shown in FIG. 4 are described in detail herein. Rather, unless described otherwise below, a feature designated by a reference numeral will be understood to be substantially similar to the previously described feature.

As shown in FIG. 4, the earth-boring tool 100 comprises a drag bit having the plurality of cutting elements 102 disposed within the pockets 110 of the plurality of blades 116 (i.e., 116*a* through 116*f*) of the body 104. The earth-boring tool 100 of FIG. 4 may be substantially similar to the earth-boring tool 100 shown in FIGS. 1 and 3, except that the earth-boring tool 100 may include one or more of the shaped inserts 106 disposed within the pockets 110 of a group of three adjacent blades 116 (e.g., 116*a*, 116*e*, and 116*f*). In such a configuration, the shaped inserts 106 may be positioned within the pockets 110 of each of designated blades 116*a*, 116*e*, and 116*f* and may be located proximate to the cutting elements 102, providing a total of six of the shaped inserts 106, two of which are located on each of the designated blades 116*a*, 116*e*, and 116*f* As discussed above with reference to FIG. 3, one or more rows (e.g., a single row) of the cutting elements 102 may be located proximate to the front cutting edge of each of the blades 116 (e.g., between the rotationally leading edge and the shaped inserts 106) and the shaped inserts 106 may be positioned to rotationally follow the cutting elements 102 on the same blade 116. In other words and by way of example only, two of the shaped inserts 106 may be positioned within the pockets 110 on each of the designated blades 116*a*, 116*e*, and 116*f* of the group of three adjacent blades 116, making a total of six of the shaped inserts 106, while another group of one or more adjacent blades 116 including all remaining blades 116*b* through 116*d* lack any of the shaped inserts 106. However, it is to be appreciated that any number of the shaped inserts 106 may be positioned in the pockets 110 and located proximate to (e.g., rotationally following) the cutting elements 102 on the same blade 116 in order to provide effective cutting for the formation type to be cut along with providing stability to the earth-boring tool 100.

FIGS. 5A through 7B show graphs depicting laboratory test results for the earth-boring tool 100 configured similar to the fixed-cutter rotary drill bit of FIG. 1. In particular, the drill bits utilized during testing included a 12¼ in. drag bit including 19-mm cutting elements, along with shaped cutting elements (e.g., STAYTRUE™ Shaped Diamond Element Technology) commercially available through Baker Hughes Incorporated of Houston, Tex., positioned on a bit body having a six-blade configuration. For the specific bit configurations utilized during testing, the imbalance force was calculated to be a magnitude of 6.9% in the 55.22° direction. During testing, the drag bits respectively incorporated three distinct configurations involving a first bit configuration including the cutting elements 102 (exclusively) with no shaped inserts 106. A second bit configuration included the cutting elements 102 with two of the shaped inserts 106 strategically placed on three adjacent blades 116. Specifically, two of the shaped inserts 106 were placed on each of blades 1, 5, and 6, while no shaped inserts 106 were placed on remaining blades 2 through 4. A third bit configuration included the cutting elements 102 with two of the shaped inserts 106 strategically placed on two adjacent blades 116. Specifically, two of the shaped inserts 106 were placed on each of blades 1 and 6, while no shaped inserts 106 were placed on remaining blades 2 through 5. The first, second, and third bit configurations are indicated in each of FIGS. 5A through 7B as "No Inserts," "2 Inserts/Blade 3 Blades," and "2 Inserts/Blade 2 Blades," respectively. It may be noted that additional bit configurations for a drill bit having shaped inserts positioned on all blades were included in the testing procedure. However, such test results are not included in the graphs of the disclosure, as the fully loaded bit configuration was used as a baseline for the present test results. Of general significance in the graphs of FIGS. 5A through 7B is that the data points obtained during testing depicted in "groups" or "clusters" tend to illustrate increased stability in each of the plots and are primarily observed with data points related to the second and third bit configurations. For example, each of the plots in the graph of FIGS. 5A through 7B exhibits approximately four or five "groups" of data points. In addition, it may be noted that "noise" is typically observed at the beginning of each testing procedure until the bit is stabilized.

Figure 5A:
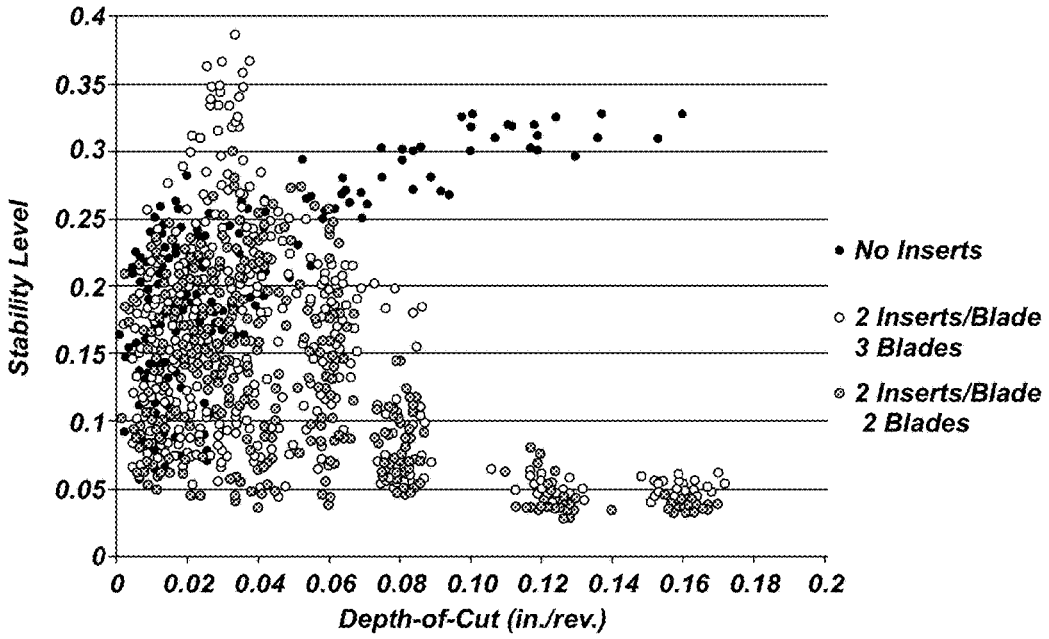
FIG. 5A is a graph depicting laboratory test results of Stability Level versus Depth-of-Cut (DOC) for representative drill bit configurations including no shaped inserts, shaped inserts on blades 1 and 6, and shaped inserts on blades 1, 5, and 6.

FIG. 5A graphically portrays laboratory test results with respect to Stability Level versus Depth-of-Cut (DOC) (in./rev.). Stability level may be measured or computed, for example, as "Whirl Traction" or "μ Variation" (i.e., coefficient of variation of the axial aggressiveness) in a given formation at a given DOC. In the present testing procedures, a stability level having a coefficient of 0.1 or below was considered to indicate a stable bit. Of significance is the magnitude of the difference in utilizing selective placement of shaped inserts as shown in the graph of FIG. 5A. The magnitude of the plot of data points of the second and third bit configurations utilizing shaped inserts on three and two adjacent blades, respectively, is expectedly less than the magnitude of the plot of data points of the first bit configuration utilizing no shaped inserts. However, the plots of the second and third bit configurations utilizing shaped inserts are markedly different than the plot of the first bit configuration, indicating significant improvement in stability level of the bit configurations utilizing selective placement of the shaped inserts. As shown in the graph of FIG. 5A, the second and third bit configurations fully stabilize by around 48 ft./hr (i.e., 0.08 in./rev). In addition, the plot for the third bit configuration (i.e., two blades) has lower peaks than the second bit configuration (i.e., three blades) and shows signs of the bit stabilizing sooner, which test results were unexpected given the slight modifications between the latter two bit configurations. These results are attributable to the selective placement of the shaped inserts providing improved stability of the bit by enhancing imbalance forces while engaging the formation in accordance with the present disclosure as will become even more apparent in yet to be discussed FIGS. 7A and 7B.

Figure 5B:
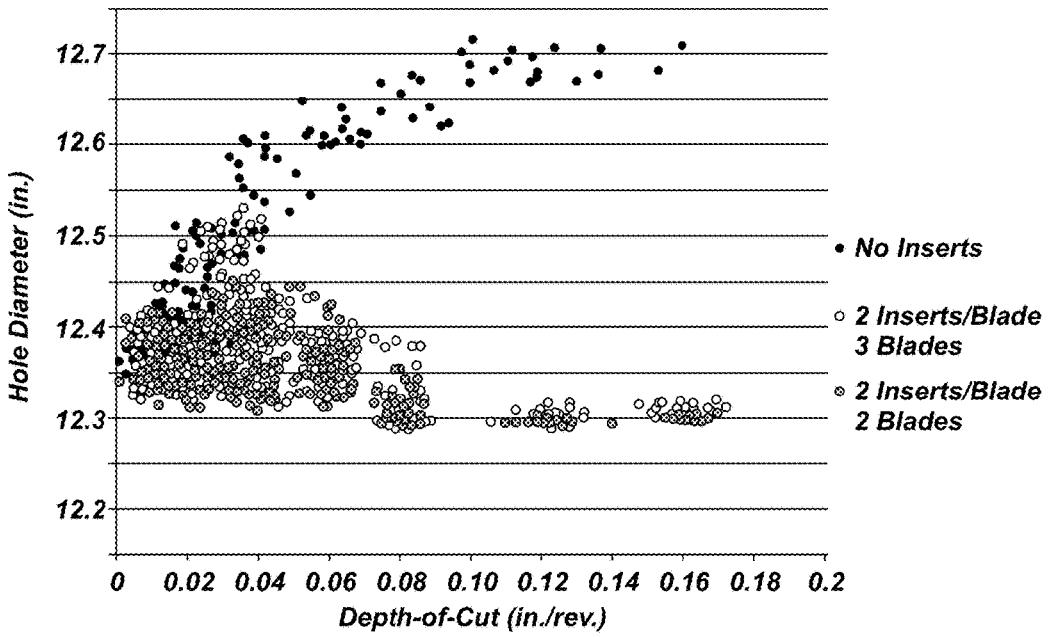
FIG. 5B is a graph depicting laboratory test results of Hole Diameter versus DOC for the tested drill bit configurations.

FIG. 5B graphically portrays laboratory test results with respect to Hole Diameter (in.) versus Depth-of-Cut (DOC) (in./rev.). Similar to FIG. 5A, of significance in FIG. 5B is the magnitude of the difference in utilizing selective placement of shaped inserts. Specifically, the plots of the second and third bit configurations utilizing shaped inserts are markedly different than the plot of the first bit configuration, indicating significant improvement in reducing hole diameter when drilling with the second and third bit configurations utilizing selective placement of the shaped inserts. It may be noted that a reduced hole diameter (i.e., approximating the diameter of the bit) is desirable, as an oversized hole diameter is generally an indication of instability in a drill bit, which in turn requires an increased amount of energy required to remove a given volume of rock. As shown in the graph of FIG. 5B, the plot for the third bit configuration (i.e., two blades) has lower peaks than the second bit configuration (i.e., three blades) and shows signs of the bit stabilizing sooner, which test results were again unexpected given the slight modifications between the bit configurations.

Figure 6:
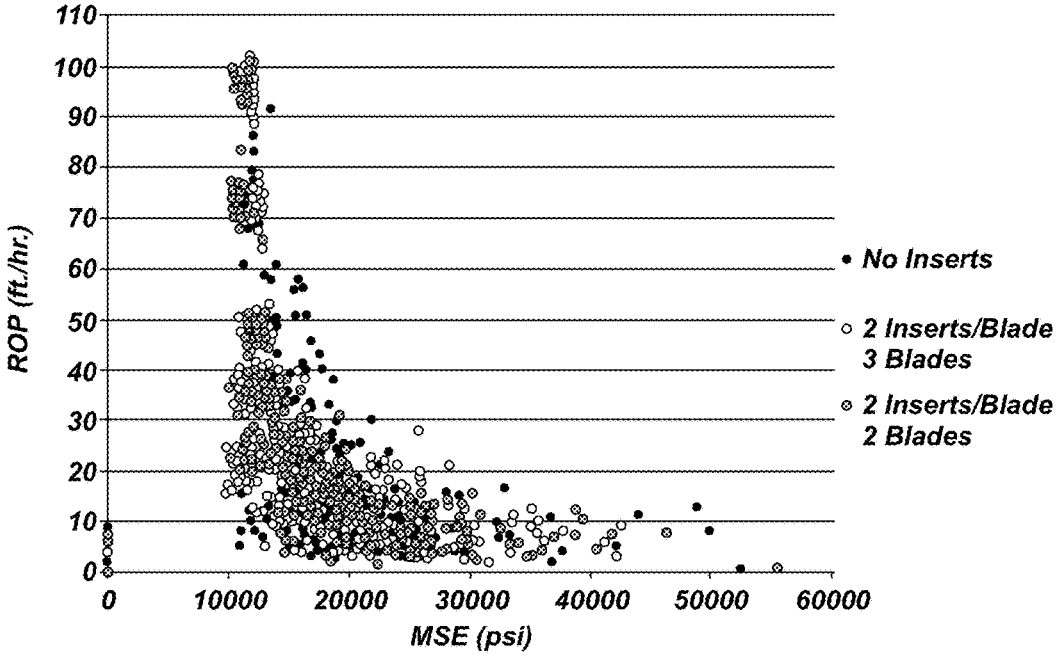
FIG. 6 is a graph depicting laboratory test results of ROP versus MSE for the tested drill bit configurations.

FIG. 6 depicts laboratory test results of Rate-of-Penetration (ROP) (ft./hr.) versus Mechanical Specific Energy (MSE) (psi). Typically, a higher ROP for a given MSE is desirable. Assessing data from so-called "power curves" on graphs displaying ROP versus MSE may be interpreted using methods summarized in U.S. Pat. No. 8,854,373, issued Oct. 7, 2014 to Pessier et al., which is assigned to the Assignee of the present disclosure, the disclosure of which is incorporated herein in its entirety by this reference. Of significance in the graph of FIG. 6 is the grouping of the data points for each of the second and third bit configurations. It may be noted that an unstable bit will provide increased scatter in the data points. Data points of the second and third bit configurations utilizing shaped inserts expectedly exhibited an increased amount of grouping compared to the scattering of data points of the first bit configuration utilizing no shaped inserts. However, test results for the third bit configuration (i.e., 2 blades) appear to show yet more consistent grouping of data points and slightly improved efficiency at higher ROPs than the test results for the second bit configuration (i.e., 3 blades), which test results were unexpected. Therefore, placement of the shaped inserts on adjacent blades (e.g., on one side of the bit body) while all other remaining blades were entirely free of shaped inserts provided a significant increase in ROPs per MSE. Thus, the selective placement of shaped inserts appears to provide greater stability, thereby providing a novel solution to the problem of natural imbalance forces while providing the additional benefit of reducing manufacturing costs.

Figure 7A:
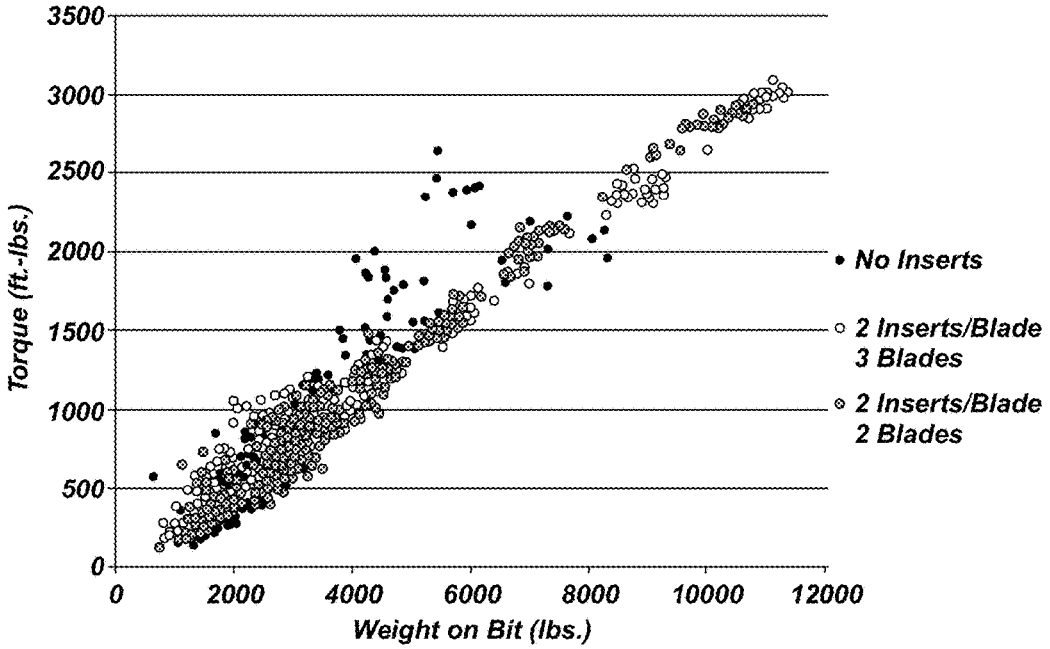
FIG. 7A is a graph depicting laboratory test results of Torque versus WOB for the tested drill bit configurations.
Figure 7B:
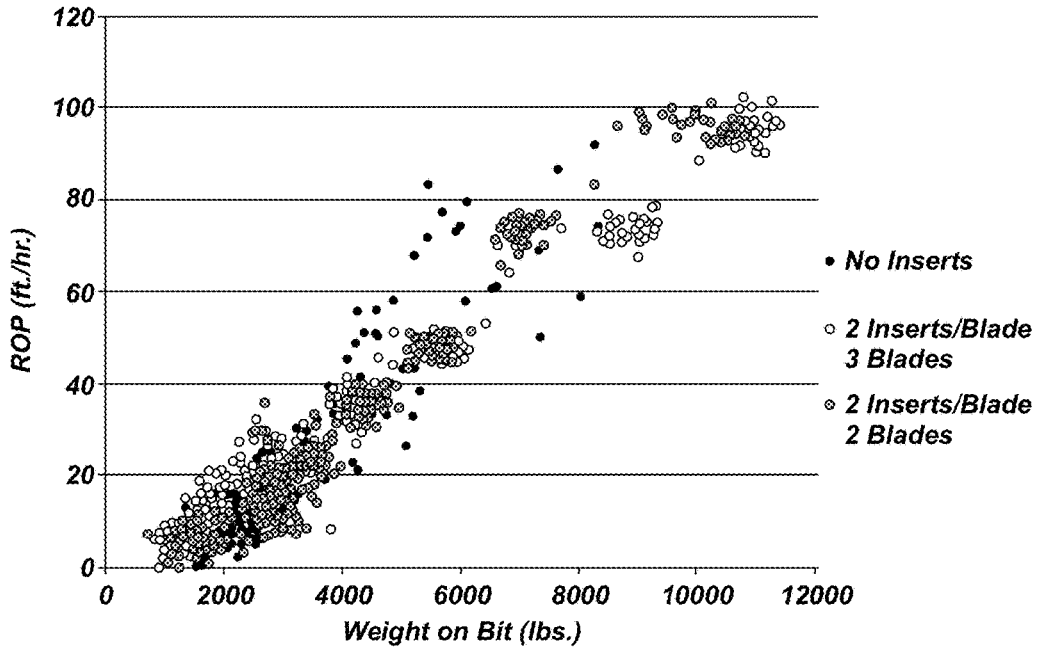
FIG. 7B is a graph depicting laboratory test results of ROP versus WOB for the tested drill bit configurations.

FIG. 7A graphically portrays laboratory test results with respect to Torque-on-Bit (TOB) (ft.-lbs.) versus Weight-on-Bit (WOB) (lbs.). Of general note in the graphs of FIGS. 7A and 7B is that "noise" may be observed at the beginning of the test for each bit configuration until the bits are stabilized at around 4000 lbs. of WOB. At that point, it may be observed that the TOB for a given WOB is significantly higher in the first bit configuration utilizing no shaped inserts. Of significance in the graph of FIG. 7A is the separation in the TOB response between the second and third bit configurations. As shown in the graph of FIG. 7A, the plot for the third bit configuration (i.e., two blades) has closer groupings (i.e., less scatter and greater separation) than the second bit configuration (i.e., three blades), which results were unexpected. The test results indicate that an increase in stability of the bit (i.e., enhancing natural imbalance forces) may enable increased WOB to be applied without the bit experiencing loss of efficiency. Thus, in order to obtain a greater ratio of TOB per WOB, a bit having selectively shaped inserts among cutting elements may be utilized.

FIG. 7B graphically portrays laboratory test results with respect to Rate-of-Penetration (ROP) (ft./hr.) versus Weight-on-Bit (WOB) (lbs.). It may be observed that the ROP for a given WOB is somewhat higher and the scattering of data points is significantly greater for the first bit configuration utilizing no shaped inserts in comparison with the plots for the second and third bit configurations. Similar to the graph of FIG. 7A, of significance in the graph of FIG. 7B is the separation in the ROP response between the second and third bit configurations. As shown in the graph of FIG. 7B, the plot for the third bit configuration (i.e., two blades) has closer groupings (i.e., less scatter and greater separation) than the second bit configuration (i.e., three blades), which results were unexpected. In addition, the plot for the third bit configuration appears to indicate that higher ROPs may be achieved per pound of WOB by effectively enhancing imbalance forces utilizing selective placement of shaped inserts. In other words, bit configurations having shaped inserts appear to have a stabilizing effect while requiring less WOB to achieve equivalent ROPs. As a result, continuously achievable ROP may be optimized and TOB controlled even under high WOB, while destructive loading of the PDC cutting elements is largely prevented.

It can now be appreciated that the present disclosure is particularly suitable for applications involving earth-boring tools that might otherwise utilize conventional placement of cutting elements and/or shaped inserts. Therefore, when implementing the present disclosure by providing a bit having selective placement of shaped inserts among cutting elements, a bit embodying the present disclosure will optimally exhibit reduced MSE for increased drilling efficiency. In particular, placement of shaped inserts on two or more adjacent blades of the bit body farthest from an imbalance force may beneficially affect stability levels and WOB, which in turn affects MSE, particularly in drilling harder subterranean formations.

Additional non-limiting example embodiments of the disclosure are set forth below.

Embodiment 1

An earth-boring tool, comprising: a body having a longitudinal axis; blades extending longitudinally and generally radially from the body; a plurality of cutting elements located on each blade; a first group of at least two adjacent blades, each blade of the first group of at least two adjacent blades comprising the plurality of cutting elements proximate a front cutting edge of the blades and at least one shaped insert located rotationally following the plurality of cutting elements; and a second group of at least one additional blade, each blade of the second group of at least one additional blade comprises the plurality of cutting elements proximate the front cutting edge of the blades while being entirely free of the at least one shaped insert.

Embodiment 2

The earth-boring tool of Embodiment 1, wherein the blades further comprise a plurality of primary blades and a plurality of secondary blades, the first group of at least two adjacent blades including at least one primary blade adjacent to at least one secondary blade.

Embodiment 3

The earth-boring tool of Embodiment 1, wherein: the first group of at least two adjacent blades containing the at least one shaped insert is located on a first side of the body farthest from an imbalance force acting on the body; and the second group of at least one additional blade being entirely free of the at least one shaped insert is located on a second side of the body closest to the imbalance force acting on the body.

Embodiment 4

The earth-boring tool of Embodiment 1, wherein the at least one shaped insert comprises two shaped inserts located on each blade of the first group of at least two adjacent blades.

Embodiment 5

The earth-boring tool of Embodiment 1, wherein the at least one shaped insert located on each blade of the first group of at least two adjacent blades comprises the at least one shaped insert being located on three adjacent blades while each blade of the second group of at least one additional blade is entirely free of the at least one shaped insert.

Embodiment 6

The earth-boring tool of Embodiment 1, wherein: the plurality of cutting elements is located at a rotationally leading edge of a respective blade; and the at least one shaped insert is positioned to rotationally follow the plurality of cutting elements on the respective blade.

Embodiment 7

The earth-boring tool of Embodiment 1, wherein the plurality of cutting elements comprises a substantially planar cutting face having an adjacent peripheral chamfered cutting edge.

Embodiment 8

The earth-boring tool of Embodiment 1, wherein a cutting face of the at least one shaped insert is at least one of dome-shaped, cone-shaped, and chisel-shaped.

Embodiment 9

The earth-boring tool of Embodiment 1, wherein: a longitudinal axis of each cutting element of the plurality of cutting elements is oriented at an angle between about 2 degrees and about 45 degrees relative to an outer surface of the blades; and a longitudinal axis of the at least one shaped insert is oriented at an angle between about 70 degrees and about 110 degrees relative to an outer surface of the blades.

Embodiment 10

The earth-boring tool of Embodiment 1, wherein an exposure of the at least one shaped insert relative to an adjacent surface of a respective blade is less than an exposure of the plurality of cutting elements relative to an adjacent surface of the respective blade.

Embodiment 11

The earth-boring tool of Embodiment 10, wherein the at least one shaped insert is at least partially located behind and not exposed above a rotationally leading cutting element secured to the same blade as the at least one shaped insert.

Embodiment 12

The earth-boring tool of Embodiment 11, wherein the at least one shaped insert is located directly rotationally behind and at least partially within a cutting path traversed by the rotationally leading cutting element.

Embodiment 13

The earth-boring tool of Embodiment 11, wherein the at least one shaped insert is located adjacent to a cutting path traversed by the rotationally leading cutting element, the at least one shaped insert positioned to directly engage a formation.

Embodiment 14

The earth-boring tool of Embodiment 1, wherein the at least one shaped insert is located in at least one of a nose region and a shoulder region of a face of the earth-boring tool.

Embodiment 15

The earth-boring tool of Embodiment 1, wherein the earth-boring tool is a fixed-cutter rotary drill bit having a body comprising steel or a hard metal matrix material.

Embodiment 16

A method of drilling a subterranean formation, comprising: applying weight-on-bit to an earth-boring tool substantially along a longitudinal axis thereof and rotating the earth-boring tool; and engaging a formation with a plurality of cutting elements and at least one shaped insert of the earth-boring tool, wherein each blade of a first group of at least two adjacent blades comprises the plurality of cutting elements proximate a front cutting edge of the blades and the at least one shaped insert located rotationally following the plurality of cutting elements while each blade of a second group of at least one additional blade comprises the plurality of cutting elements proximate the front cutting edge of the blades while being entirely free of the at least one shaped insert.

Embodiment 17

The method of Embodiment 16, further comprising enhancing imbalance forces acting on the earth-boring tool using a blade configuration that is asymmetric with respect to the longitudinal axis.

Embodiment 18

The method of Embodiment 17, wherein enhancing the imbalance forces acting on the earth-boring tool comprises using the at least one shaped insert located within the first group of at least two adjacent blades on a first side of a body of the earth-boring tool farthest from the imbalance forces acting on the body while each blade of the second group of at least one additional blade being entirely free of the at least one shaped insert is located on a second side of the body closest to the imbalance forces acting on the body during application of a selected weight-on-bit substantially along the longitudinal axis.

Embodiment 19

The method of Embodiment 16, wherein engaging the formation comprises shearing the formation with the plurality of cutting elements while gouging the formation with the at least one shaped insert.

Embodiment 20

The method of Embodiment 16, wherein engaging the formation comprises engaging the formation with at least a portion of the plurality of cutting elements located at a rotationally leading edge of a respective blade and the at least one shaped insert positioned to rotationally follow the plurality of cutting elements on the respective blade.

Although the foregoing description contains many specifics, these are not to be construed as limiting the scope of the present disclosure, but merely as providing certain exemplary embodiments. Similarly, other embodiments of the disclosure may be devised, which do not depart from the spirit or scope of the present disclosure. For example, features described herein with reference to one embodiment also may be provided in others of the embodiments described herein. The scope of the invention is, therefore, indicated and limited only by the appended claims and their legal equivalents, rather than by the foregoing description. All additions, deletions, and modifications to the disclosed embodiments, which fall within the meaning and scope of the claims, are encompassed by the present disclosure.

What is claimed is:

1. An earth-boring tool, comprising:

a body having a longitudinal axis;

blades extending longitudinally and generally radially from the body;

a plurality of cutting elements located on each blade, each cutting element of the plurality of cutting elements comprising a substantially planar cutting face;

at least one shaped insert comprising a non-planar cutting face;

a group of at least two circumferentially adjacent blades, each blade of the group of at least two circumferentially adjacent blades comprising some of the plurality of cutting elements proximate a front cutting edge of the blades and the at least one shaped insert located rotationally following the plurality of cutting elements on a respective blade; and one or more additional blades, each blade of the one or more additional blades comprising some of the plurality of cutting elements proximate the front cutting edge of the blades while being entirely free of the at least one shaped insert.

2. The earth-boring tool of claim 1, wherein the blades further comprise a plurality of primary blades and a plurality of secondary blades, the group of at least two circumferentially adjacent blades including at least one primary blade circumferentially adjacent to at least one secondary blade within the group of at least two circumferentially adjacent blades.

3. The earth-boring tool of claim 1, wherein:

the group of at least two circumferentially adjacent blades containing the at least one shaped insert is located on a first side of the body farthest from an imbalance force acting on the body; and the one or more additional blades being entirely free of the at least one shaped insert is located on a second side of the body closest to the imbalance force acting on the body.

4. The earth-boring tool of claim 1, wherein the at least one shaped insert comprises exactly two shaped inserts located on each blade of the group of at least two circumferentially adjacent blades.

5. The earth-boring tool of claim 1, wherein the at least one shaped insert located on each blade of the group of at least two circumferentially adjacent blades comprises the at least one shaped insert being located on three circumferentially adjacent blades while each blade of the one or more additional blades is entirely free of the at least one shaped insert.

6. The earth-boring tool of claim 1, wherein the plurality of cutting elements is located at a rotationally leading edge of the respective blade.

7. The earth-boring tool of claim 1, wherein the plurality of cutting elements comprises a peripheral chamfered cutting edge adjacent the substantially planar cutting face.

8. The earth-boring tool of claim 1, wherein the non-planar cutting face of the at least one shaped insert is dome-shaped, cone-shaped, or chisel-shaped.

9. The earth-boring tool of claim 1, wherein:

a longitudinal axis of each cutting element of the plurality of cutting elements is oriented at an angle between about 2 degrees and about 45 degrees relative to an outer surface of the blades; and a longitudinal axis of the at least one shaped insert is oriented at an angle between about 70 degrees and about 110 degrees relative to an outer surface of the blades.

10. The earth-boring tool of claim 1, wherein an exposure of the at least one shaped insert relative to an adjacent surface of the respective blade is less than an exposure of the plurality of cutting elements relative to an adjacent surface of the respective blade.

11. The earth-boring tool of claim 10, wherein the at least one shaped insert is at least partially located behind and not exposed above a rotationally leading cutting element secured to the same blade as the at least one shaped insert.

12. The earth-boring tool of claim 11, wherein the at least one shaped insert is located directly rotationally behind and at least partially within a cutting path traversed by the rotationally leading cutting element.

13. The earth-boring tool of claim 11, wherein at least a portion of the at least one shaped insert is located adjacent to a cutting path traversed by the rotationally leading cutting element, the at least one shaped insert positioned to directly engage a formation.

14. The earth-boring tool of claim 1, wherein the at least one shaped insert is located in at least one of a nose region and a shoulder region of a face of the earth-boring tool.

15. The earth-boring tool of claim 1, wherein the earth-boring tool is a fixed-cutter rotary drill bit having the body comprising steel or a hard metal matrix material.

16. A method of drilling a subterranean formation, comprising:

applying weight-on-bit to an earth-boring tool substantially along a longitudinal axis thereof and rotating the earth-boring tool; and engaging a formation with a plurality of cutting elements and at least one shaped insert of the earth-boring tool, wherein each blade of a group of at least two circumferentially adjacent blades comprises some of the plurality of cutting elements proximate a front cutting edge of the blades and the at least one shaped insert located rotationally following the plurality of cutting elements on a respective blade of the group while each blade of one or more additional blades comprises some of the plurality of cutting elements proximate the front cutting edge of the blades while being entirely free of the at least one shaped insert, and wherein engaging the formation comprises shearing the formation with each of the plurality of cutting elements comprising a substantially planar cutting face while gouging the formation with the at least one shaped insert comprising a non-planar cutting face.

17. The method of claim 16, further comprising enhancing imbalance forces acting on the earth-boring tool using a blade configuration that is asymmetric with respect to the longitudinal axis.

18. The method of claim 17, wherein enhancing the imbalance forces acting on the earth-boring tool comprises using the at least one shaped insert located within the group of at least two circumferentially adjacent blades on a first side of a body of the earth-boring tool farthest from the imbalance forces acting on the body while each blade of the one or more additional blades being entirely free of the at least one shaped insert is located on a second side of the body closest to the imbalance forces acting on the body during application of a selected weight-on-bit substantially along the longitudinal axis.

19. The method of claim 16, wherein engaging the formation comprises engaging the formation with at least a portion of the plurality of cutting elements located at a rotationally leading edge of the respective blade.

* * * * *